US007129451B2

(12) United States Patent
Lee

(10) Patent No.: US 7,129,451 B2
(45) Date of Patent: Oct. 31, 2006

(54) MICROWAVE OVEN

(75) Inventor: Tae-Hoon Lee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 10/950,506

(22) Filed: Sep. 28, 2004

(65) Prior Publication Data

US 2006/0081621 A1 Apr. 20, 2006

(51) Int. Cl.
*H05B 6/64* (2006.01)

(52) U.S. Cl. ..... 219/685; 219/628

(58) Field of Classification Search ..... 219/685, 219/684, 683, 682, 681, 680, 679, 678
See application file for complete search history.

(56) References Cited

U.S. PATENT DOCUMENTS 3,716,687 A * 2/1973 Constable ..... 219/681
3,920,944 A * 11/1975 Constable ..... 219/685
4,298,780 A * 11/1981 Suzuki ..... 219/685
5,793,023 A * 8/1998 Hong et al. ..... 219/685
6,037,569 A * 3/2000 Lincoln et al. ..... 219/388
6,528,772 B1 * 3/2003 Graves et al. ..... 219/680

FOREIGN PATENT DOCUMENTS

KR 95-6884 U 3/1995
KR 1996-41885 A 12/1996

* cited by examiner

*Primary Examiner*—Daniel Robinson
(74) *Attorney, Agent, or Firm*—Birch, Stewart, Kolasch & Birch, LLP

(57) ABSTRACT

The present invention relates to a microwave oven. According to the present invention, a fixed heater 41 is installed on a ceiling of a cavity 31 of a microwave oven, and a pivotable heater 43 is installed to pivot upward and downward on its lower end in the cavity 31. When the pivotable heater 43 has been pivoted downward on its lower end, a grill 45 on which an object to be heated is seated is horizontally installed between a lower surface of the fixed heater 41 and an upper surface of the pivotable heater 43. A micro-switch 51, which will be pushed by the grill 45 and thus generate an actuating signal for pivoting the pivotable heater 43, is installed on a side surface of the cavity 31. According to the present invention, since the fixed and pivotable heaters 41 and 43 heat upper and lower surfaces of the object, respectively, and the pivotable heater 43 is pivoted according to whether the grill 45 is mounted or detached, it is possible to cook the object faster and more conveniently.

20 Claims, 4 Drawing Sheets

FIG. 1 BACKGROUND ART
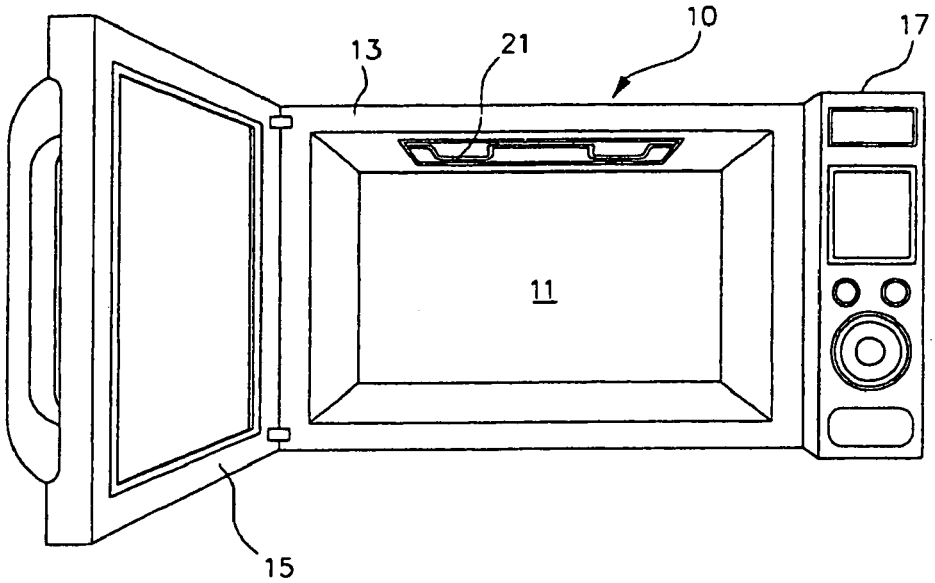
FIG. 2a BACKGROUND ART
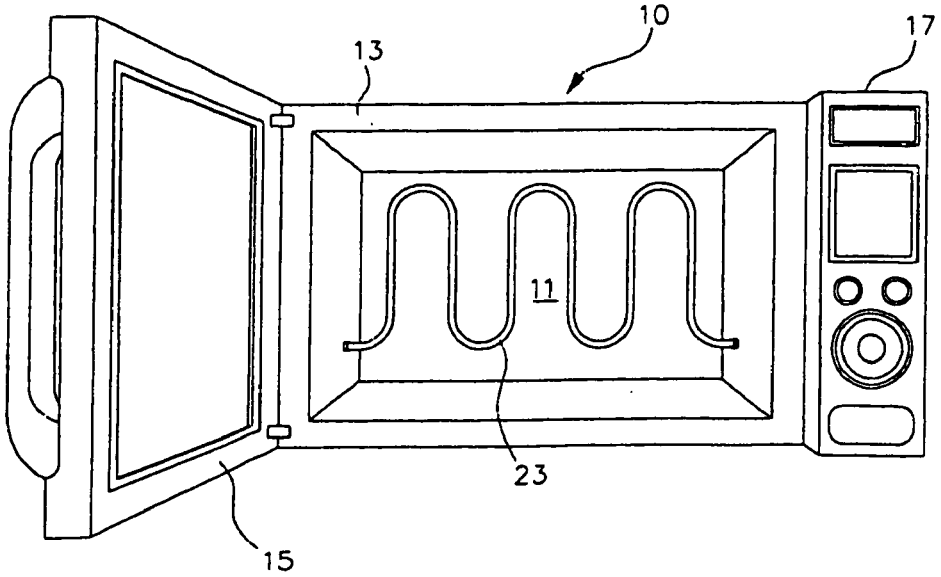

FIG. 2b BACKGROUND ART
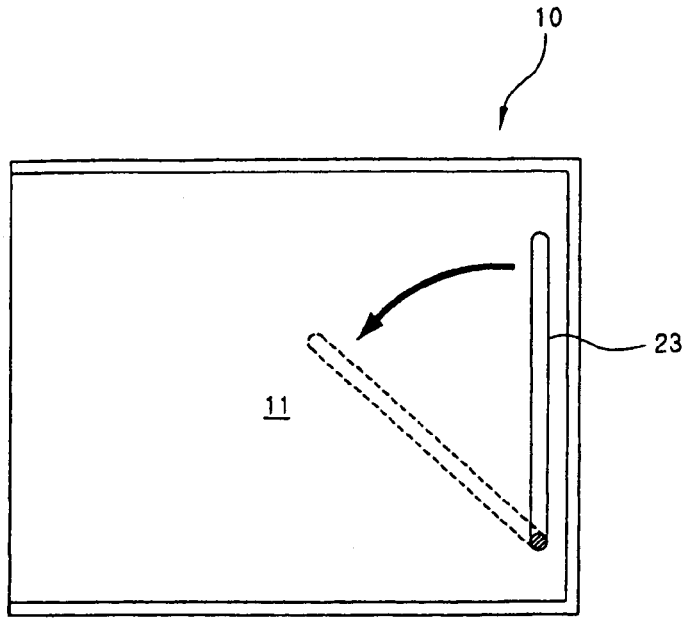
FIG. 3
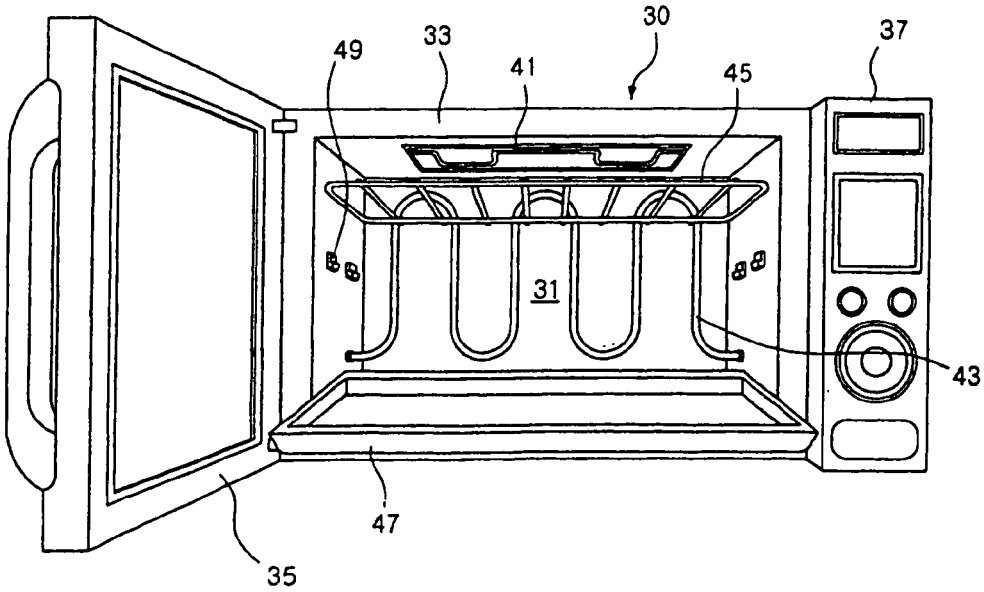

MICROWAVE OVEN

BACKGROUND OF THE INVENTION

1. Field of Invention

The present invention relates to a microwave oven, and more particularly, to a microwave oven capable of uniformly heating an object by means of a plurality of heaters.

2. Description of the Prior Art

A general microwave oven is to heat an object by irradiating microwaves into a cavity of the microwave oven. However, a latest microwave oven has employed heaters as another heat source in addition to the microwaves in order to heat the object in a variety of fashions.

FIG. 1 shows a major portion of a conventional microwave oven. FIG. 2*a* shows a major portion of another conventional microwave oven. FIG. 2*b* is a sectional view showing the interior of a cavity of the microwave oven shown in FIG. 2*a*.

As shown in FIG. 1, a main body 10 of the microwave oven is provided with a cavity 11 with an open front face as a space in which an object is heated by means of microwaves or heat of heaters. Further, a door 15 for opening and closing the cavity 11 is hingedly installed at a front plate 13 defining the front face of the main body 10.

A side of the cavity 11 in the main body 10 is provided with an electronic equipment installation chamber (not shown) in which parts for generating microwaves such as a magnetron and a high voltage transformer are installed. A control panel 17 is installed on a portion corresponding to the front of the electronic equipment installation chamber. The control panel 17 functions to receive a variety of signals for operating the microwave oven and to display a variety of information during the operation of the microwave oven.

In order to heat the object put into the cavity 11, a fixed heater 21 is installed in the cavity 11. The fixed heater 21 is mounted, for example, on a ceiling of the cavity 11 to heat a surface of the object, thereby complementing disadvantages in a microwave-heating fashion.

In addition, the conventional microwave oven shown in FIGS. 2*a* and 2*b* is provided with a pivotable heater 23, which is upward and downward pivotably installed at a rear portion of the cavity 11. That is, the pivotable heater 23, which is vertically installed adjacent to a rear surface of the cavity 11, may upward and downward pivot on its lower end through a predetermined angle according to food as an object to be cooked so that the distance between the pivotable heater 23 and the object decreases.

Therefore, radiant or convective heat from the pivotable heater 23 may be more effectively transmitted to the object to be heated in the cavity 11. In the meantime, the other constitutional elements except for the pivotable heater 23 of the microwave oven shown in FIGS. 2*a* and 2*b* are the same as the microwave oven shown in FIG. 1. Thus, like reference numerals are given to designate like other elements.

However, the conventional microwave ovens have the following problems.

As described above, the conventional microwave ovens heat the object (food) by means of the fixed heater 21 installed on the ceiling of the cavity 11 or the pivotable heater 23 installed to pivot through a predetermined angle on the lower end thereof at the rear portion of the cavity 11.

However, since the object to be cooked is seated on a lower surface of the cavity 11, a lower surface of the object cannot be heated by the fixed or pivotable heater 21 or 23. Therefore, there is a disadvantage in that the object should be inconveniently turned over in order to heat the lower surface of the object seated in the cavity 11 by using the heater 21 or 23.

In addition, the pivotable heater 23 should be pivoted upward and downward by hand or by a driving motor. In the case that the heater is pivoted by hand, there is inconvenience in that the pivotable heater 23 should be pivoted by hand whenever cooking is made using the pivotable heater 23. Furthermore, when the pivotable heater 23 is pivoted to be in a vertical state after cooking the object, a user may get burned by remaining heat caused from the pivotable heater 23.

SUMMARY OF THE INVENTION

Accordingly, the present invention is conceived to solve the aforementioned problems in the prior art. An objective of the present invention is to provide a microwave oven configured to uniformly heat upper and lower surfaces of an object by means of heat from heaters.

Another objective of the present invention is to provide a microwave oven which makes it possible to uniformly heat an object by automatically pivoting one of heaters toward a lower side of the object when the object is heated using the heaters.

According to the present invention for achieving the objectives, there is provided a microwave oven, comprising a main body including a cavity with an open front face serving as a space in which an object is heated; a fixed heater fixed on a ceiling of the cavity to irradiate heat; a pivotable heater installed within the cavity to pivot toward a vertical position adjacent to a rear surface of the cavity and a position adjacent to a lower surface of the cavity; and a grill which is detachably mounted in an intermediate inner portion of the cavity between the fixed and pivotable heaters when the pivotable heater is pivoted downward and on which the object is seated.

The pivotable heater may be pivotably installed on lower ends of both sides thereof which are supported at rear portions of both side surfaces of the cavity.

The microwave oven may further comprise a driving means for pivoting the pivotable heater.

The microwave oven may further comprise a switching means for generating an actuating signal for pivoting the pivotable heater upward and downward so that the driving means pivots the pivotable heater.

The switching means may comprise a micro-switch installed on a side surface of the cavity to come into contact with the grill when the grill is mounted. The micro-switch may be installed at a position on a side surface of the cavity so that the micro-switch is pushed by any one of both side surfaces of the grill when the grill is mounted.

According to the present invention, the microwave oven uniformly heats upper and lower surfaces of the object seated on the grill by using the fixed and pivotable heaters. Thus, it is possible to expect an advantage in that the entire object can be uniformly heated.

In addition, during the process of mounting the grill into the cavity, a side surface of the grill pushes the micro-switch, whereby the actuating signal is generated. Accordingly, the pivotable heater pivots upward and downward. Thus, there is an advantage in that cumbersomeness of the manual operation for pivoting the pivotable heater can be eliminated, resulting in simplified operation of the microwave oven.

BRIEF DESCRIPTION OF THE DRAWINGS

The above and other objectives, features and advantages of the present invention will become apparent from the following description of a preferred embodiment given in conjunction with the accompanying drawings, in which:

FIGS. 1 and 2*a* are perspective views showing major portions of conventional microwave ovens;

FIG. 2*b* is a sectional side view showing the interior of a cavity of the microwave oven shown in FIG. 2*a;*

FIG. 3 is a perspective view of a preferred embodiment of a microwave oven according to the present invention.

DETAILED DESCRIPTION OF THE PREFERRED EMBODIMENT

Figure 4A:
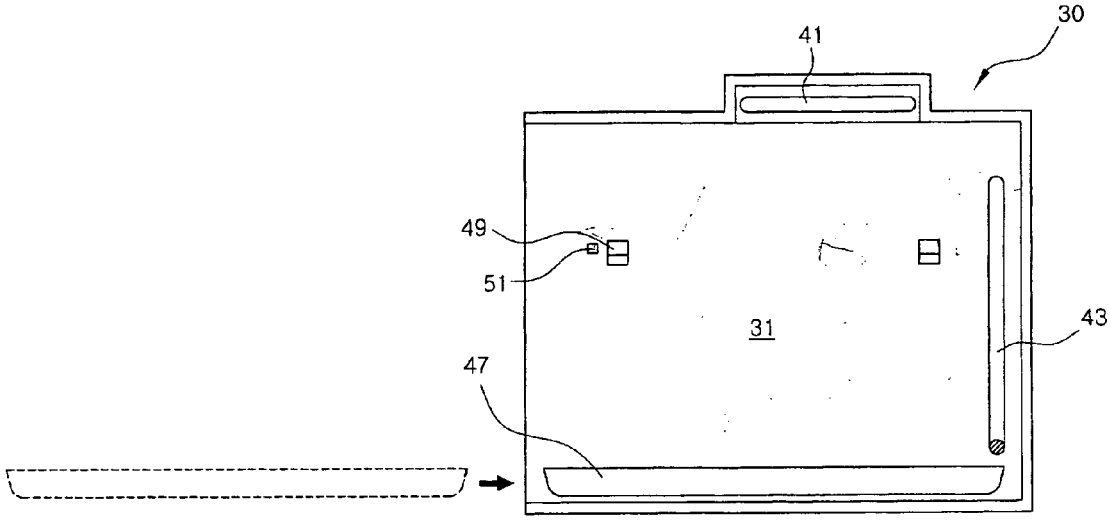
FIGS. 4*a* to 4*c* are views showing the operation of the embodiment shown in FIG. 3.

Hereinafter, the present invention will be described in detail in connection with an embodiment shown in the accompanying drawings.

FIG. 3 shows a major portion of a preferred embodiment of a microwave oven according to the present invention. As shown in the figure, a main body 30 of the microwave oven is provided with a cavity 31 which has an open front face, in order to heat an object. In addition, a door 35 for opening and closing the cavity 31 is hingedly installed on a side surface of a front plate 33 defining a front face of the main body 30.

In addition, a side of the cavity 31 in the main body 30 is provided with an electronic equipment installation chamber (not shown) in which parts for generating microwaves such as a magnetron, a high voltage transformer, and a high voltage capacitor are installed. A control panel 37, which functions to receive a variety of signals for operating the microwave oven and to display a variety of information during the operation of the microwave oven, is installed on a portion of the front plate 33 corresponding to the front of the electronic equipment installation chamber.

A plurality of heaters for heating the object put into the cavity 31 are installed in the cavity 31. The heaters including a fixed heater 41 and a pivotable heater 43 heat a surface of the object, and thus, function to complement disadvantages of a microwave-heating fashion.

The fixed heater 41 is fixed on a ceiling of the cavity 31 and irradiates heat downward. In the pivotable heater 43, both side ends thereof are pivotably supported at rear portions of both side surfaces of the cavity 31. Thus, the pivotable heater 43 is installed to pivot upward and downward on both side ends thereof.

In addition, since the pivotable heater 43 is formed in a zigzag shape, it can irradiate heat to a predetermined area. Further, the pivotable heater 43 is installed to pivot by means of a driving motor (not shown). Thus, due to forward and rearward rotation of the driving motor, it is possible for the pivotable heater 43 to pivot between its substantially vertical and horizontal positions on both the side ends thereof.

A grill 45 on which the object, i.e., food to be heated, is put is installed within the cavity 31. It is preferred that the grill 45, on which the object to be cooked using the fixed and pivotable heaters 41 and 43 is seated, be horizontally installed. The grill 45 is detachably mounted to be positioned between a lower portion of the fixed heater 41 and an upper portion of the pivotable heater 43 in a state where the pivotable heater 43 pivots downward on its lower end.

That is, when the object seated on the grill 45 is heated, the heaters should operate at upper and lower portions of the object in order to uniformly heat the upper and lower portions of the object. To uniformly heat the food, while the pivotable heater 43 pivots downward on its lower end and heats the lower portion of the food, the fixed heater 41 installed on the ceiling of the cavity 31 heats the upper portion of the food.

To uniformly heat the object on the grill 45 as described above, although the pivoting of the pivotable heater 43 may be manually performed, it is preferred that the pivotable heater 43 be pivoted toward a lower surface of the cavity 31 by using the driving motor. That is, the pivotable heater 43 may be installed so that it can be pivoted between a position adjacent to the rear surface of the cavity and a position adjacent to the lower surface of the cavity by the motor of which the rotation direction and the number of revolutions can be controlled. In addition, the pivotable heater 43 may be supported to be held at any positions between the two positions. The transmission of rotational force between such a motor and the end of the pivotable heater 43 may be implemented using known mechanisms.

A tray 47 may be installed on the lower surface of the cavity 31. The tray 47 functions to collect oil and fat generated when the object seated on the grill 45 is heated by the heaters 41 and 43. In addition, it is preferred that the tray 47 be detachably installed to cast away the oil and fat collected during the heating.

In the meantime, a plurality of guides 49 for guiding and supporting the grill 45 are installed on both the side surfaces of the cavity 31. Two pairs of guides 49 are installed to be flush with each other on the respective side surfaces of the cavity 31. That is, the grill 45 enters and leaves the cavity 31 in a fore and aft direction while both sides of a lower surface thereof are guided by the guides 49, and is supported by the guides 49 when the grill 45 has been installed in the cavity 31.

To pivot the pivotable heater 43, a switching device for transmitting electric signals to the driving motor for operating the pivotable heater 43 is required. That is, it is preferred that the switching device, which may shift the pivotable heater 43 from the vertical position to the horizontal position by user's operation of the switching device or by the mounting of the grill 45, be installed at a portion of the microwave oven. If the user directly operates such a switching device by hand, the switching device may be installed at any position.

Figure 4B:
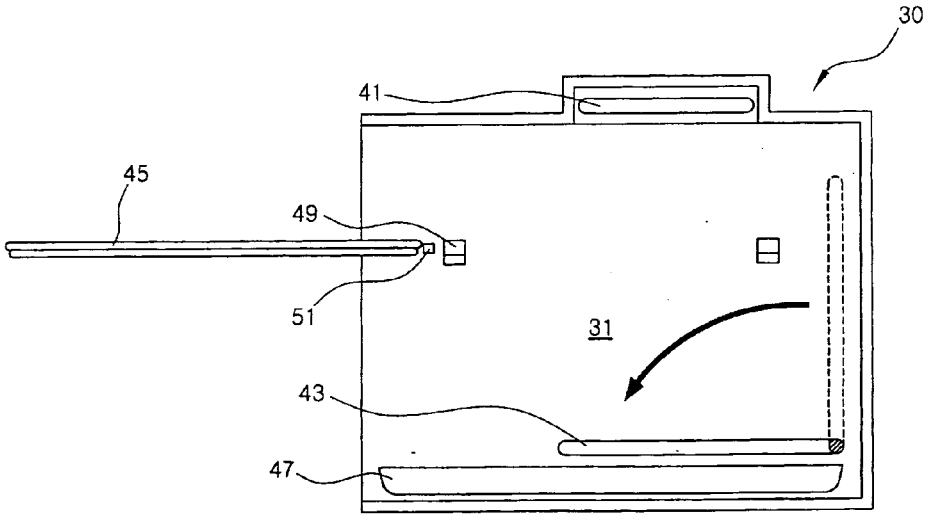
Figure 4C:
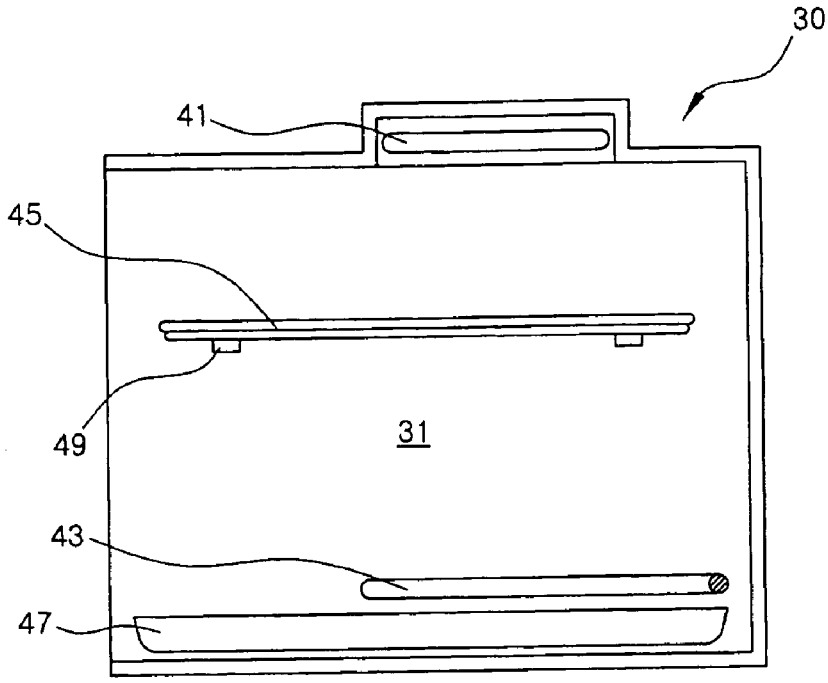

To change the position of the pivotable heater 43, in the embodiment shown in FIGS. 4*a* to 4*c*, at least one micro-switch 51 is installed on a side surface of the cavity 31. The micro-switch 51 is installed at a front portion of the side surface of the cavity 31 corresponding to a side surface of the grill 45 which enters and leaves the cavity 31 in the fore and aft direction along the guides 49. If the micro-switch 51 is installed in just front of the guides 49, the grill 45 inserted along the guides 49 may push the micro-switch 51.

Therefore, to heat the object simultaneously using the fixed and pivotable heaters 41 and 43, when the user inserts the grill 45 into the cavity 31 while the grill 45 is supported by the guides 49, the side surface of the grill 45 comes into contact with the micro-switch 51. When the micro-switch 51 is pushed accordingly and then generates a contact signal, the signal of the micro-switch 51 is transmitted to the motor for driving the pivotable heater 43, for example, through the control panel 37. Then, the pivotable heater 43 pivots forward and is shifted to the position adjacent to the lower surface of the cavity 31.

That is, it can be understood that the micro-switch 51 is the switching device for pivoting and shifting the pivotable heater 43 to any positions between the vertical position adjacent to the rear surface of the cavity 31 and the horizontal position adjacent to the lower surface of the cavity 31.

Hereinafter, the operation of the preferred embodiment of the microwave oven according to the present invention constructed as above will be described in detail with reference to FIGS. 4*a* to 4*c*.

FIGS. 4*a* to 4*c* show the operation of the preferred embodiment of the microwave oven according to the present invention. To cook food using the heaters in the microwave oven, the tray 47 is first installed on the lower surface of the cavity 31 of the microwave oven for collecting the oil and fat generated during cooking, as shown in FIG. 4*a*.

Then, the grill 45 on which the object is seated is installed in the cavity 31. Here, as shown in FIGS. 4*b* and 4*c*, the grill 45 slides along upper portions of the guides 49 formed on both the side surfaces of the cavity 31 and moves toward the rear portion of the cavity 31. During the insertion of the grill 45, a front end of the left side surface of the grill 45 pushes the micro-switch 51 installed on the left side surface of the cavity 31.

Therefore, the micro-switch 51, which has been pushed by the grill 45, generates the actuating signal for pivoting the pivotable heater 43 downward on its lower end. Then, the actuating signal causes the pivotable heater 43 to pivot downward. It is preferred that the signal be transmitted from the micro-switch to the motor for driving the pivotable heater, for example, via the control panel 37 installed in front of the microwave oven.

In addition, in a case where the pivotable heater 43 is pivoted by means of an additional switching device, the pivotable heater 43 should be pivoted and shifted to the horizontal position shown in FIG. 4*b* by actuating the additional switching device before the grill 45 is inserted. It will be apparent that the pivotable heater 43 should be pivoted downward before the grill 45 is inserted even in a case where the pivotable heater 43 is operated by hand.

In such a state, the object to be heated is seated on the grill 45, that is, the object is positioned between the fixed and pivotable heaters 41 and 43. In addition, when the object is seated on the grill 45, the user closes the cavity 31 by pivoting the door 35 of the microwave oven and then inputs operating signals into the microwave oven by manipulating the control panel 37.

When the operating signals are input through the control panel 37, electric power is supplied to the microwave oven by means of the operating signals, causing the heaters 41 and 43 to heat the object. Heat generated from the heaters 41 and 43 cooks the object seated on the grill 45.

When the object is heated, the pivotable heater 43 positioned below the grill 45 can intensively heat the lower portion of the object, while the fixed heater 41 positioned above the object can intensively heat the upper portion of the object. With the use of the heaters 41 and 43 of the present invention as described above, the entire upper and lower portions of the object can be uniformly heated.

That is, the object is heated in the state where it is seated between the fixed and pivotable heaters 41 and 43. Therefore, with radiant or convective heat transfer, the upper and upper side surfaces of the object are heated by the fixed heater 41, while the lower and lower side surfaces of the object are heated by the pivotable heater 43. Accordingly, the entire object on the grill 45 can be heated uniformly using the two heaters without turning over the object.

In a case where according to an object to be cooked, the object is cooked by means of microwaves without using the heaters 41 and 43 or the object is heated with the pivotable heater 43 without pivoting thereof, it will be apparent that the microwave oven should be operated after removal of the grill 45.

When the object is completely heated through the above process, the grill 45 should be taken out from the cavity 31. To remove the grill 45 from the cavity 31, the grill 45 is pulled toward the front of the cavity 31 along the guides 49. Due to the removal of the grill, the micro-switch 51 is no longer pushed by the left side surface of the grill 45.

When the micro-switch 51 and the grill 45 are separated from each other, the micro-switch 51 generates an actuating signal for pivoting the pivotable heater 43 upward on its lower end. Then, the pivotable heater 43 is pivoted by means of the actuating signal from the micro-switch 51 and shifted to the substantially vertical position adjacent to the rear surface of the cavity 31.

According to the present invention described above, it can be understood that the fundamental technical spirit of the present invention is to heat an object by a pair of heaters installed in the cavity of the microwave oven and positioned above and below the grill on which the object is seated. In addition, the pivotable heater which can pivot toward a position below the grill is constructed to be operated, for example, as the grill pushes the micro-switch during the process of mounting the grill 45.

As described above, in the microwave oven according to the present invention, the fixed and pivotable heaters are installed on the ceiling of the cavity and on any one of both the side surfaces and the rear surface of the cavity, respectively. As the object is put on the grill horizontally installed between the fixed and pivotable heaters and is then heated by the heaters, the lower surface as well as the upper surface of the object can be uniformly heated. Due to such a heating fashion, there is an advantage in that the entire upper and lower portions of the object can be uniformly heated using heat generated from the heaters without turning over the object.

In addition, according to the embodiment of the present invention in which the micro-switch for use in driving the pivotable heater is installed corresponding to the installation position of the grill, one side of the grill pushes the micro-switch installed on the cavity during the process of mounting the grill, thereby generating the actuating signal for pivoting the pivotable heater. Thus, it is possible to reduce cumbersomeness, such as a manual operation for pivoting the pivotable heater or actuation of an additional switch for operating the pivotable heater. In addition, there is an advantage in that a burn which may occur during the manual pivoting process of the pivotable heater can be prevented.

It will be apparent that those skilled in the art can make various modifications and changes within the scope of the fundamental technical spirit of the present invention. Therefore, the scope of the present invention should be construed on the basis of the appended claims.

Although the pivotable heater is installed at the rear portions of both the side surfaces of the cavity in the illustrated embodiment, the present invention is not limited thereto. For example, the pivotable heater may be installed on one side surface of the cavity, or two pivotable heaters may be installed on both the side surfaces of the cavity.

Furthermore, although a single micro-switch is installed on the left side surface of the cavity in the illustrated embodiment, the installation position of the micro-switch and the number of micro-switches are not limited thereto.

What is claimed is:

1. A microwave oven, comprising:

a microwave oven main body including a cavity with an open front face serving as a space in which an object is heated;

a pivotable heater installed within the cavity to pivot from a first position to a second position ranging from a substantially vertical position adjacent to a rear surface of the cavity to a substantially horizontal position adjacent to a lower surface of the cavity; and a grill detachably mounted in the cavity between top surface of the cavity and the lower surface of the cavity when the pivotable heater is pivoted below the grill, the object being seatable on the grill.

2. The microwave oven as claimed in claim 1, wherein the pivotable heater is pivotably installed on lower ends of both sides thereof which are supported at rear portions of both side surfaces of the cavity.

3. The microwave oven as claimed in claim 1, further comprising a driving means for pivoting the pivotable heater.

4. The microwave oven as claimed in claim 3, further comprising a switching means for generating an actuating signal for pivoting the pivotable heater upward and downward so that the driving means pivots the pivotable heater.

5. The microwave oven as claimed in claim 4, wherein the switching means comprises a micro-switch installed on a side surface of the cavity to come into contact with the grill when the grill is mounted.

6. The microwave oven as claimed in claim 5, wherein the micro-switch is installed at a position on a side surface of the cavity so that the micro-switch is pushed by any one of both side surfaces of the grill when the grill is mounted.

7. The microwave oven as claimed in claim 4, wherein the grill is guided and supported by a plurality of guides installed on both side surfaces of the cavity when the grill is inserted into the cavity, and the switching means is installed on a front portion of a side surface of the cavity to be pushed by the grill mounted on the guides.

8. The microwave oven as claimed in claim 1, further comprising a tray installed on the lower surface of the cavity to collect oil and fat generated from the object seated on the grill.

9. The microwave oven as claimed in claim 1, wherein the second position is the substantially horizontal position adjacent to a lower surface of the cavity.

10. The microwave oven as claimed in claim 1, further comprising a fixed heater fixed on a ceiling of the cavity to irradiate heat.

11. The microwave oven as claimed in claim 1, further comprising a plurality of guides on a left side and a right side of the cavity for guiding and supporting the grill in the cavity.

12. A microwave oven, comprising:

a main microwave oven body including a cavity with an open front face serving as a space in which an object is heated;

a grill detachably mounted between a top surface of the cavity and a lower surface of the cavity; and a pivotable heater installed within the cavity to pivot from a first position to a second position ranging from a substantially vertical position adjacent to a side surface of the cavity to a position below the grill when the grill is mounted.

13. The microwave oven as claimed in claim 12, wherein the second position is the position below the grill when the grill is mounted.

14. The microwave oven as claimed in claim 12, further comprising a fixed heater fixed on a ceiling of the cavity to irradiate heat.

15. The microwave oven as claimed in claim 12, further comprising a plurality of guides on a left side and a right side of the cavity for guiding and supporting the grill in the cavity.

16. The microwave oven as claimed in claim 12, wherein the side surface is a rear side surface of the cavity.

17. The microwave oven as claimed in claim 12, wherein the side surface is a left side surface or a right side surface of the cavity.

18. The microwave oven as claimed in claim 12, further comprising driving means for pivoting the pivotable heater; and switching means for generating an actuating signal for pivoting the pivotable heater from the first position to the second position so that the driving means pivots the pivotable heater.

19. The microwave oven as claimed in claim 18, wherein the switching means includes a micro-switch installed on a left or right side surface of the cavity to come into contact with the grill when the grill is mounted.

20. A microwave oven, comprising:

a microwave oven main body including a cavity with an open front face serving as a space in which an object is heated;

a fixed heater fixed on a ceiling of the cavity to irradiate heat;

a pivotable heater installed within the cavity to pivot toward a vertical position adjacent to a rear surface of the cavity and a position adjacent to a lower surface of the cavity;

a grill detachably mounted in an intermediate inner portion of the cavity between the fixed and pivotable heaters when the pivotable heater is pivoted downward, the object being seated on the grill;

driving means for pivoting the pivotable heater; and switching means for generating an actuating signal for pivoting the pivotable heater upward and downward so that the driving means pivots the pivotable heater.

* * * * *